US006693849B1

(12) United States Patent
Eberl et al.

(10) Patent No.: US 6,693,849 B1
(45) Date of Patent: Feb. 17, 2004

(54) PIEZOELECTRIC AUDIO TRANSDUCER

(76) Inventors: Adolf Eberl, c/o Special Electronics & Designs Inc., 214 Bruce Avenue, Kincardine, Ontario (CA), N2Z 2P3; Peter Eberl, c/o Special Electronics & Designs Inc., 214 Bruce Avenue, Kincardine, Ontario (CA), N2Z 2P3; Rolf Eberl, c/o Special Electronics & Designs Inc., 214 Bruce Avenue, Kincardine, Ontario (CA), N2Z 2P3

( * ) Notice: Subject to any disclaimer, the term of this patent is extended or adjusted under 35 U.S.C. 154(b) by 0 days.

(21) Appl. No.: 10/264,147

(22) Filed: Oct. 3, 2002

(51) Int. Cl.[7] ..... H04R 25/00

(52) U.S. Cl. ..... 367/160; 367/157; 381/173; 381/190

(58) Field of Search ..... 310/337; 367/157, 367/160, 162, 180; 381/173, 190

(56) References Cited

U.S. PATENT DOCUMENTS

| | | | | |
|---|---|---|---|---|
| 3,562,451 A | | 2/1971 | Mullen et al. | 179/187 |
| 4,013,992 A | | 3/1977 | Dewberry et al. | 340/10 |
| 4,156,800 A | * | 5/1979 | Sear et al. | 381/173 |
| 4,733,379 A | * | 3/1988 | Lapetina et al. | 367/162 |
| 5,117,403 A | * | 5/1992 | Eberl et al. | 367/175 |
| 5,218,576 A | | 6/1993 | DeChico | 367/171 |
| 6,389,140 B1 | | 5/2002 | Wei | 381/173 |

* cited by examiner

*Primary Examiner*—Ian J. Lobo
(74) *Attorney, Agent, or Firm*—Woodard, Emhardt, Moriarty, McNett & Henry LLP

(57) ABSTRACT

A piezoelectric audio transducer suitable for underwater use comprises a piezoelectric ceramic plate within a housing having open front face and back faces exposing the front and back faces of the ceramic plate to ambient pressure. The ceramic plate can be supported in spaced relation from the housing by, for example, open cell foam, so as to be vibrationally isolated from the housing.

16 Claims, 3 Drawing Sheets

PIEZOELECTRIC AUDIO TRANSDUCER

BACKGROUND OF INVENTION

This invention relates to a piezoelectric audio transducer, such as a microphone.

Piezoelectric microphones suited for underwater use are known. For example, in U.S. Pat. No. 5,218,576 to De Chico a piezoelectric microphone has a piezoceramic transduction layer and a metal substrate with a thin film of viscous fluid between them. The viscous film allows the transduction layer and substrate to expand and contract relative to each other when the laminate bends under increasing hydrostatic pressure as the transducer descends in a body of water. While this arrangement reduces hydrostatic stresses, such stresses are not eliminated.

U.S. Pat. No. 4,013,992 to Bewberry et al. describes a microphone intending to expose both sides of the piezoelectric ceramic plate to ambient pressure. This would tend to avoid bending under increased hydrostatic pressure. However, it is believed that the design may be improved.

Accordingly, the present invention seeks to provide an improved piezoelectric audio transducer.

SUMMARY OF INVENTION

A piezoelectric audio transducer suitable for underwater use comprises a piezoelectric ceramic plate within a housing having open front face and back faces exposing the front and back faces of the ceramic plate to ambient pressure. The ceramic plate can be supported in spaced relation from the housing by, for example, open cell foam, so as to be vibrationally isolated from the housing.

According to the invention, there is provided, a piezoelectric audio transducer comprising: a piezoelectric ceramic plate; a housing for said ceramic plate, said housing having an open front face exposing a front face of said ceramic plate to ambient pressure and an open back face exposing a back face of said ceramic plate to ambient pressure.

Other features and advantages of the invention will be apparent after a review of the following description in conjunction with the drawings.

BRIEF DESCRIPTION OF THE DRAWINGS

In the drawings which illustrate an example embodiment of this invention.

DETAILED DESCRIPTION

Figure 1:
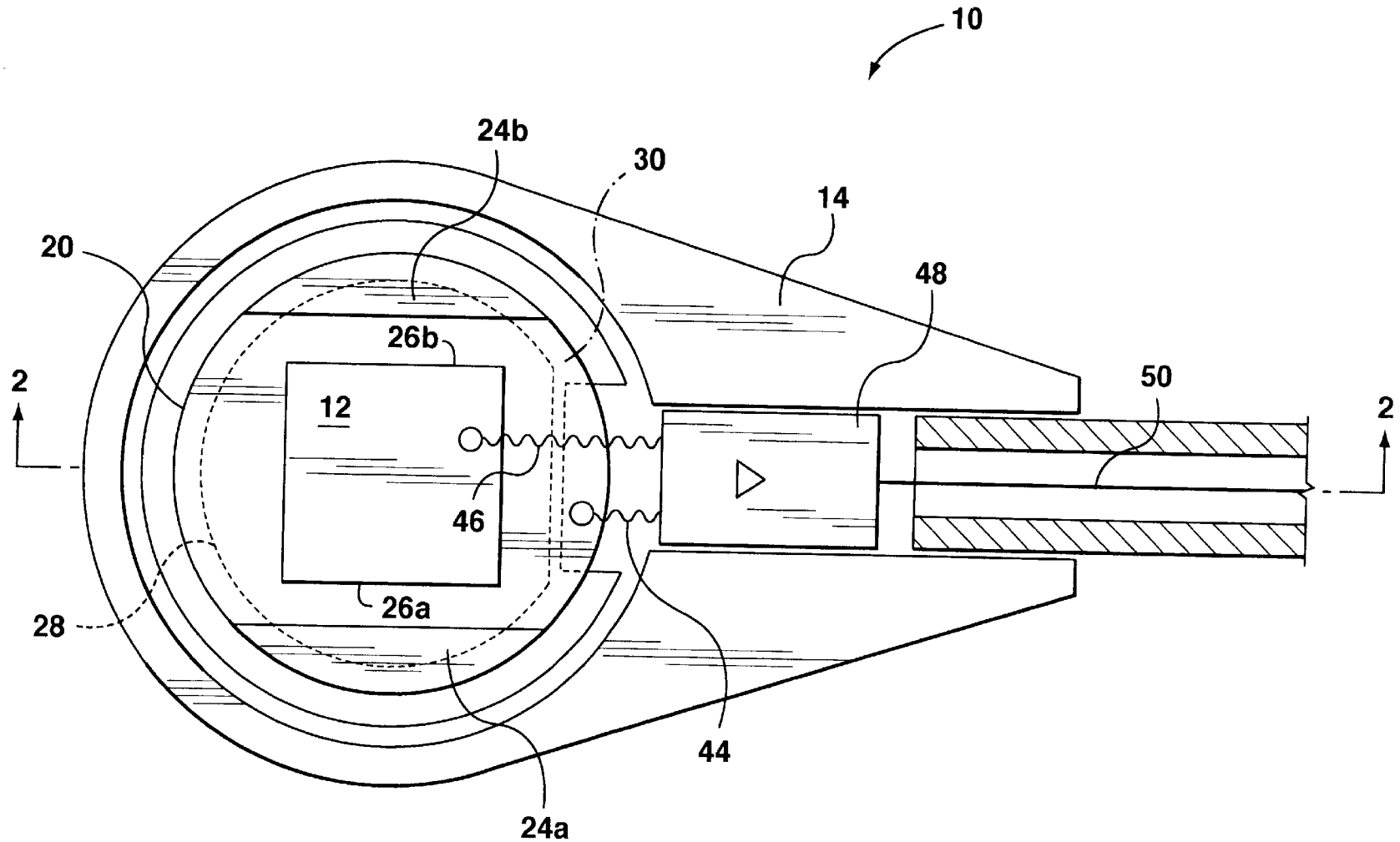
FIG. 1 is a plan view of a microphone made in accordance with this invention.
Figure 2:
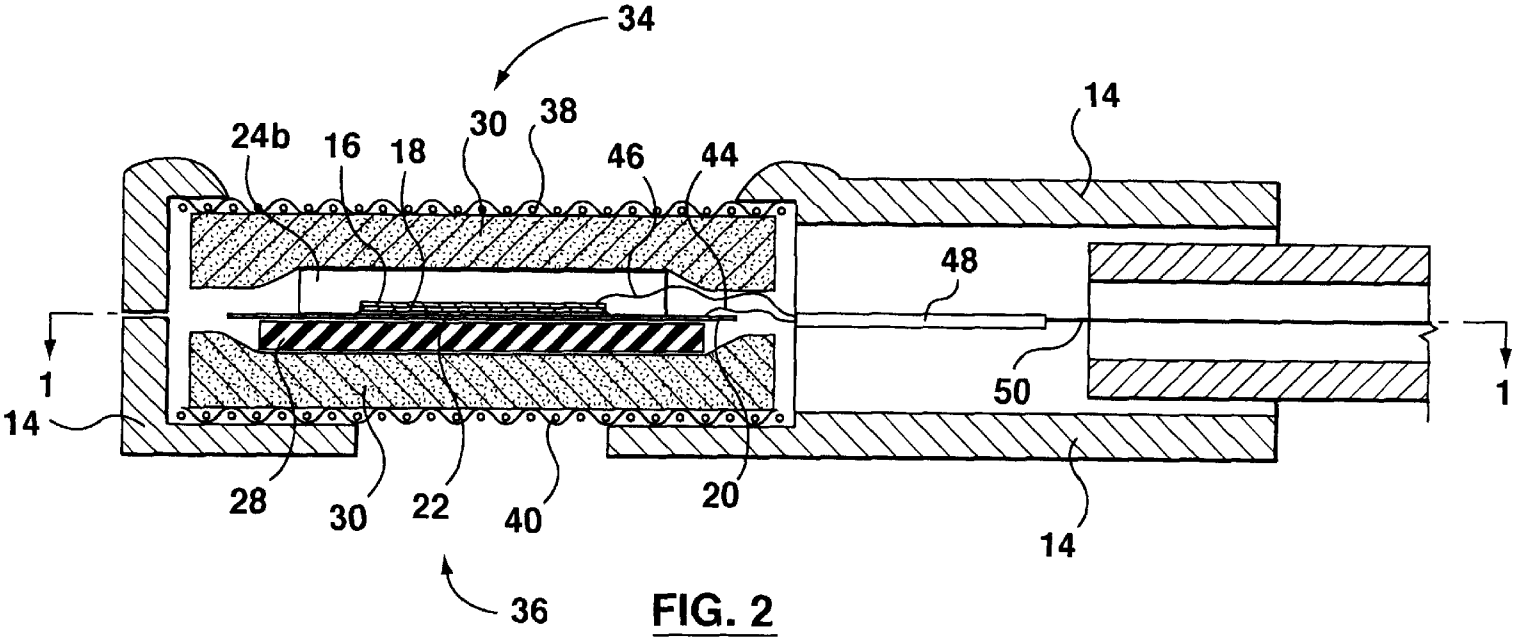
FIG. 2 is a cross-sectional view along the lines II—II of FIG. 1.
Figure 3:
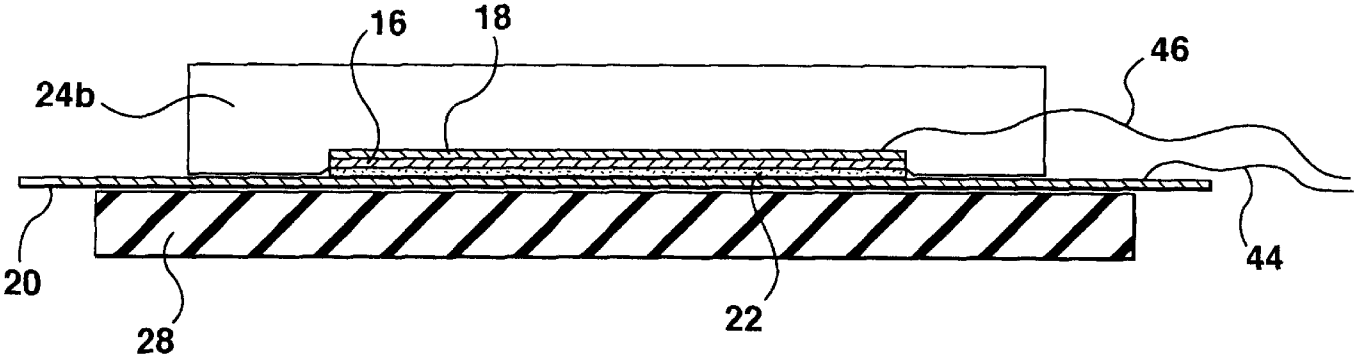
FIG. 3 is a view of a portion of FIG. 2.

With reference to FIGS. 1 to 3, a piezoelectric microphone 10 comprises a piezoelectric plate 12 within a housing 14. The housing may be fabricated of metal or metalised plastic and electrically grounded. The plate comprises a ceramic or crystal piezoelectric wafer 16 with a front face coated with a metal layer 18 and a back face attached face-to-face to a conductive vibratile membrane 20 by a layer of conductive glue 22. However, wafer 16 is assumed to be ceramic so that plate 12 is referred to as a ceramic plate. The conductive vibratile membrane may be fabricated of metal, or a metalised plastic. An insulating layer is formed over the ceramic plate.

The membrane 20 may extend beyond a periphery of the back face of the piezoelectric wafer 16 to support a pair of inertial weights 24*a*, 24*b* that are attached to the vibratile membrane 20 adjacent opposite sides 26*a*, 26*b* of the piezoelectric wafer 16.

A damping body may be attached to the ceramic plate. The damping body may comprise rubber disk 28 attached to the back face of the vibratile membrane. The ceramic plate 12, with rubber disk 28, is enveloped by an envelope 30 of open cell foam such that the plate is spaced from the housing. The foam, being rigid enough, locates the ceramic plate within the housing. Being open celled, the foam is highly porous.

The housing 14 has a large front opening 34 exposing the entire front face of the ceramic plate 12. The housing also has a large back opening 36 exposing substantially the entire back face of the ceramic plate 12. A metal front screen 38 extends across the front opening 34 and a metal back screen 40 extends across the rear opening 36. These screens, which may be made of stainless steel, are connected into the housing 14.

An output wire 44 is connected to the conductive membrane 20 and another 46 is connected to the metal layer 18. These wires 44, 46 may connect to a pre-amp 48 which, in turn, outputs to dual signal wire 50.

The microphone may be used as a lip microphone in air. When the microphone is submerged in water, water enters the housing through the front and back openings 34, 36 and flows through the open cell foam envelope 30. This exposes the front and back faces of the ceramic plate 12 to the ambient pressure. Thus, no matter what the ambient hydrostatic pressure, this pressure is applied equally to both the front and back faces of the ceramic plate. In consequence, hydrostatic stresses on the ceramic plate are avoided.

When the microphone emerges from water, the water within the housing will readily and quickly drain from the open cell foam envelope 30 through the front and back openings in the housing 14.

Since water moves freely into and out of the microphone, the microphone will be available for use within moments of leaving the water.

The open cell foam envelope 30 also provides good vibrational isolation between the housing 14 and the ceramic plate 12. With vibrations in the housing substantially isolated from the ceramic plate, a potential source of noise is substantially reduced.

When a user speaks into the front opening 34 of the housing 14, sound waves impinge on the front face of the ceramic plate 12. Provided the user speaks directly into the front opening and the housing is close to the user's lips less sound energy will impinge on the back face of the ceramic plate. This difference in the sound energy impinging on the front and back faces of the ceramic plate results in plate vibration and an output from the microphone. On the other hand, for distant sound sources, there will be little, if any, difference between the energy impinging upon the front and back faces of the plate. In consequence, background noise is substantially, or completely, cancelled at the microphone. Thus, another potential source of noise is miniminized. The inertial weights proximate the periphery of the ceramic plate are relatively immobile in the presence of sound energy compared to the ceramic plate due to their much higher mass. Thus, the inertial weights help ensure the ceramic plate bends in the presence of the sound energy rather than simply be displaced. The bending of the ceramic plate distorts the structure of the wafer 16 producing a voltage proportional to the bending of the wafer. Thus, the impinging sound waves are converted into electrical signals which pass to the pre-amplifier 48 and output on output dual wire 50.

The screens 38, 40 with the grounded housing 14 shield the output signal from stray voltages. The rubber disk 28 dampens the vibration produced by sound wave pressure changes and suppresses resonant frequencies.

Figure 4:
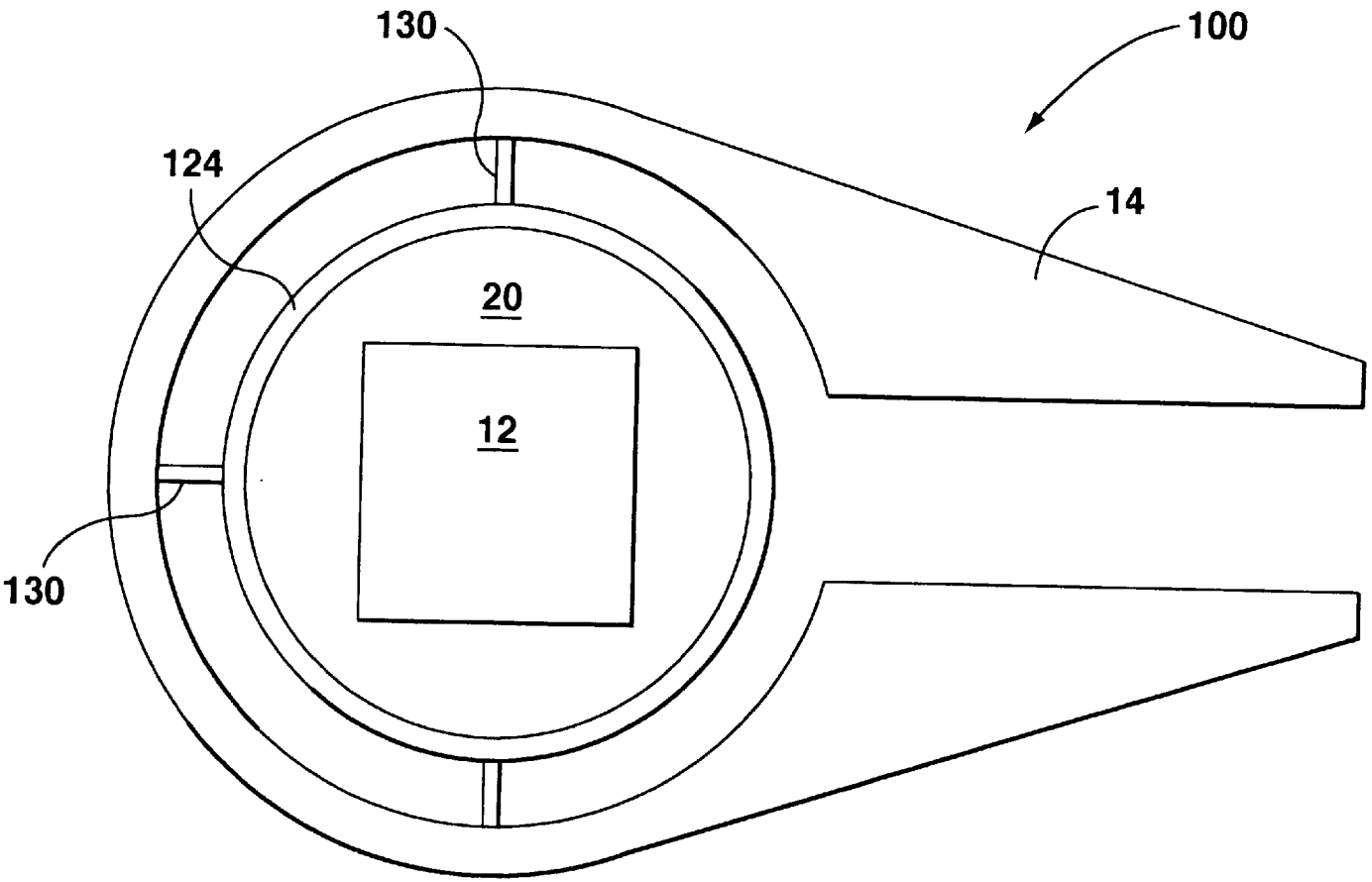
FIG. 4 is a plan view of a microphone made in accordance with another embodiment of this invention.

In FIG. 4, which illustrates a further embodiment of this invention, like parts have been given like reference numerals. Microphone 100 differs from microphone 10 (FIGS. 1 and 2) in that the pair of opposed inertial weights 24*a*, 24*b* (FIGS. 1 to 3) has been replaced by an inertial ring weight 124. The inertial ring weight serves the same purpose as the pair of opposed weights. However, the ring weight will tend to stiffen the ceramic plate which lowers its sensitivity to sound energy.

In the embodiment of FIG. 4, the open cell foam envelope 30 (FIGS. 1 and 2) has been replaced by ligaments 130 attaching the ring weight 124, and hence the ceramic plate 12 to the housing 14. The ligaments locate the ceramic plate within the housing but leave both faces of the ceramic plate exposed to the ambient pressure. Additionally, because the ligaments provide only a small area of connection between the housing and the ceramic plate, the ligaments also help minimize the passage of vibrational energy in the housing to the ceramic plate.

In further embodiments of the invention, the open cell foam envelope 30 (FIGS. 1 to 3) may be replaced by any other material that is highly porous and capable of locating the ceramic plate within the housing. For example, a course rubber sponge or flexible spider suspension may provide a suitable support.

As will be appreciated by those skilled in the art, with appropriate electronics, microphone 10 (FIG. 1) or 100 (FIG. 4) could be converted into a sound projector. Thus, the apparatus of the invention is a sound transducer, rather than being solely a microphone.

Other modifications will be apparent to those skilled in the art and, therefore, the invention is defined in the claims.

What is claimed is:

1. A piezoelectric audio transducer comprising:

a piezoelectric plate;

a housing for said plate, said housing having an open front face exposing a front face of said plate to ambient pressure and an open back face exposing a back face of said plate to ambient pressure; said piezoelectric plate being located in spaced relation to said housing; and at least one weight attached to said plate comprising one of a ring weight extending proximate a periphery of said plate and a pair of weights positioned proximate a periphery of said plate opposite one another.

2. The transducer of claim 1 wherein said plate comprises a piezoelectric crystal wafer and a vibratile membrane, attached face-to-face.

3. The transducer of claim 2 wherein said vibratile membrane extends beyond a periphery of a back face of said piezoelectric crystal wafer and said at least one weight is attached to said vibratile membrane adjacent said periphery of said back face of said piezoelectric crystal wafer.

4. The transducer of claim 1 further comprising at least two ligaments suspending said plate within said housing.

5. The transducer of claim 3 further comprising open cell foam enveloping said plate and locating said plate within said housing in spaced relation to said housing.

6. The transducer of claim 1 wherein said housing is conductive and grounded and further comprising a metal screen extending across said open front face of said housing and a metal screen extending across said open back face of said housing.

7. The transducer of claim 2 further comprising a metalised layer over a front face of said wafer and wherein said vibratile membrane of said plate is conductive.

8. The transducer of claim 7 further comprising a non-conductive protective layer over said plate.

9. The transducer of claim 1 wherein said open front face of said housing exposes at least substantially all of said front face of said plate and said open back face of said housing exposes at least substantially all of said back face of said plate.

10. The transducer of claim 3 further comprising a damping body attached to said plate.

11. The transducer of claim 3 wherein said at least one weight is attached to a front face of said vibratile membrane.

12. A piezoelectric audio transducer comprising:

a piezoelectric plate;

a housing for said plate, said housing having an open front face exposing a front, face of said plate to ambient pressure and an open back face exposing a back face of said plate to ambient pressure; and a porous envelope enveloping said plate and locating said plate within said housing in spaced relation to said housing.

13. The transducer of claim 12 wherein said porous envelope is fabricated of open cell foam.

14. The transducer of claim 12 further comprising a ring weight extending proximate a periphery of said plate.

15. The transducer of claim 12 further comprising a pair of weights positioned proximate a periphery of said plate opposite one another.

16. A piezoelectric microphone comprising:

a piezoelectric plate;

a housing for said plate, said housing having an open front face exposing a front face of said plate to ambient pressure and an open back face exposing a back face of said plate to ambient pressure; and a porous envelope enveloping said plate and locating said ceramic plate within said housing in spaced relation to said housing.

* * * * *